US007063514B1

(12) United States Patent
Wu

(10) Patent No.: US 7,063,514 B1
(45) Date of Patent: Jun. 20, 2006

(54) AIR PUMP CAPABLE OF INFLATING AN INFLATABLE OBJECT

(76) Inventor: Hsin-Tsai Wu, 1F, No. 19, Alley 3, Lane 106, Sec. 3, Min-Chuan E. Rd., Taipei City (TW)

( * ) Notice: Subject to any disclaimer, the term of this patent is extended or adjusted under 35 U.S.C. 154(b) by 0 days.

(21) Appl. No.: 11/041,654

(22) Filed: Jan. 24, 2005

(30) Foreign Application Priority Data

Dec. 1, 2004 (CN) ..... 2004 2 0116013

(51) Int. Cl.
*F04B 17/03* (2006.01)

(52) U.S. Cl. ..... 417/317; 417/366; 417/423.1

(58) Field of Classification Search ..... 417/317, 417/366, 423.1
See application file for complete search history.

(56) References Cited

U.S. PATENT DOCUMENTS 6,413,056 B1 * 7/2002 Chou ..... 417/366
6,503,065 B1 * 1/2003 Tanaka et al. ..... 417/366
6,530,751 B1 * 3/2003 Song et al. ..... 417/423.1
6,709,246 B1 * 3/2004 Boyd ..... 417/423.1
2004/0202559 A1 * 10/2004 Yen ..... 417/423.1

* cited by examiner

*Primary Examiner*—Michael Koczo, Jr.
(74) *Attorney, Agent, or Firm*—Allston L. Jones

(57) ABSTRACT

An air pump is capable of inflating an inflatable object, and includes a housing unit, a motor and a fan. The motor and the fan are disposed within the housing unit. The housing unit is formed with a pair of first and second intake port units and an exhaust port unit. The fan includes a middle plate connected fixedly to a driving shaft of the motor, and a pair of first and second fan blade units extending respectively from two opposite side surfaces of the middle plate. Air is sucked into the housing unit by the first and second fan blade units through the first and second intake port units, respectively, and is subsequently forced out of the housing unit by the first and second fan blade units through the exhaust port unit.

11 Claims, 6 Drawing Sheets

AIR PUMP CAPABLE OF INFLATING AN INFLATABLE OBJECT

CROSS-REFERENCE TO RELATED APPLICATION

This application claims priority of Chinese Application No. 200420116013.7, filed on Dec. 1, 2004.

BACKGROUND OF THE INVENTION

1. Field of the Invention

This invention relates to an air pump, and more particularly to an air pump that is capable of inflating an inflatable object.

2. Description of the Related Art

Referring to FIGS. 1 and 2, a conventional air pump 2 is capable of inflating an inflatable object 1, and is shown to include a housing body 21, a motor 22, a fan 23 and a cap 24. The housing body 21 is tubular, and has an intake port unit 211 disposed at one end of the housing body 21, and a first projection 212 extending radially and outwardly from the other end of the housing body 21. The motor 22 is disposed within the housing body 21, and includes a driving shaft 221. The cap 24 is connected fixedly to the housing body 21, and is formed with a second projection 241 extending radially and outwardly therefrom. The housing body 21 and the cap 24 constitute cooperatively a housing unit. The first and second projections 212, 241 cooperate with each other to form an exhaust tube 25 that engages an intake valve 11 of the inflatable object 1. The fan 23 is disposed between the housing body 21 and the cap 24, and is sleeved fixedly on the driving shaft 221 of the motor 22. The fan 23 is aligned with the first and second projections 212, 241 in a radial direction of the driving shaft 221 of the motor 22. When the driving shaft 221 of the motor 22 rotates within the housing body 21, air is sucked into the housing unit by the fan 23 through the intake port unit 211, and is forced out of the housing unit by the fan 23 through the exhaust tube 25. Therefore, the inflatable object 1 is inflated. An exhaust valve 12 of the inflatable object 1 can be opened so as to allow for deflation of the inflatable object 1. Because the fan 23 includes only one fan blade unit 231 extending from a side surface of a middle plate 232, the inflating performance of the air pump 2 is limited.

SUMMARY OF THE INVENTION

The object of this invention is to provide a high-performance air pump that is capable of inflating an inflatable object.

Accordingly, an air pump of this invention is adapted to inflate an inflatable object. The inflatable object has an air inlet. The air pump includes a housing unit, a motor and a fan. The housing unit has a pair of first and second intake port units, and an exhaust port unit that is adapted to be in fluid communication with the air inlet in the inflatable object. The motor is installed within the housing unit, and includes a driving shaft journalled in the housing unit. The fan is disposed within the housing unit, and includes a middle plate connected fixedly to the driving shaft of the motor, and a pair of first and second fan blade units extending respectively from two opposite side surfaces of the middle plate. The motor can be driven to rotate the fan within the housing unit. As a result, air is sucked into the housing unit by the first and second fan blade units through the first and second intake port units, respectively, and is subsequently forced out of the housing unit by the first and second fan blade units through the exhaust port unit. Since the fan includes two fan blade units (i.e. the first and second fan blade units), the inflating performance of the air pump is enhanced.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
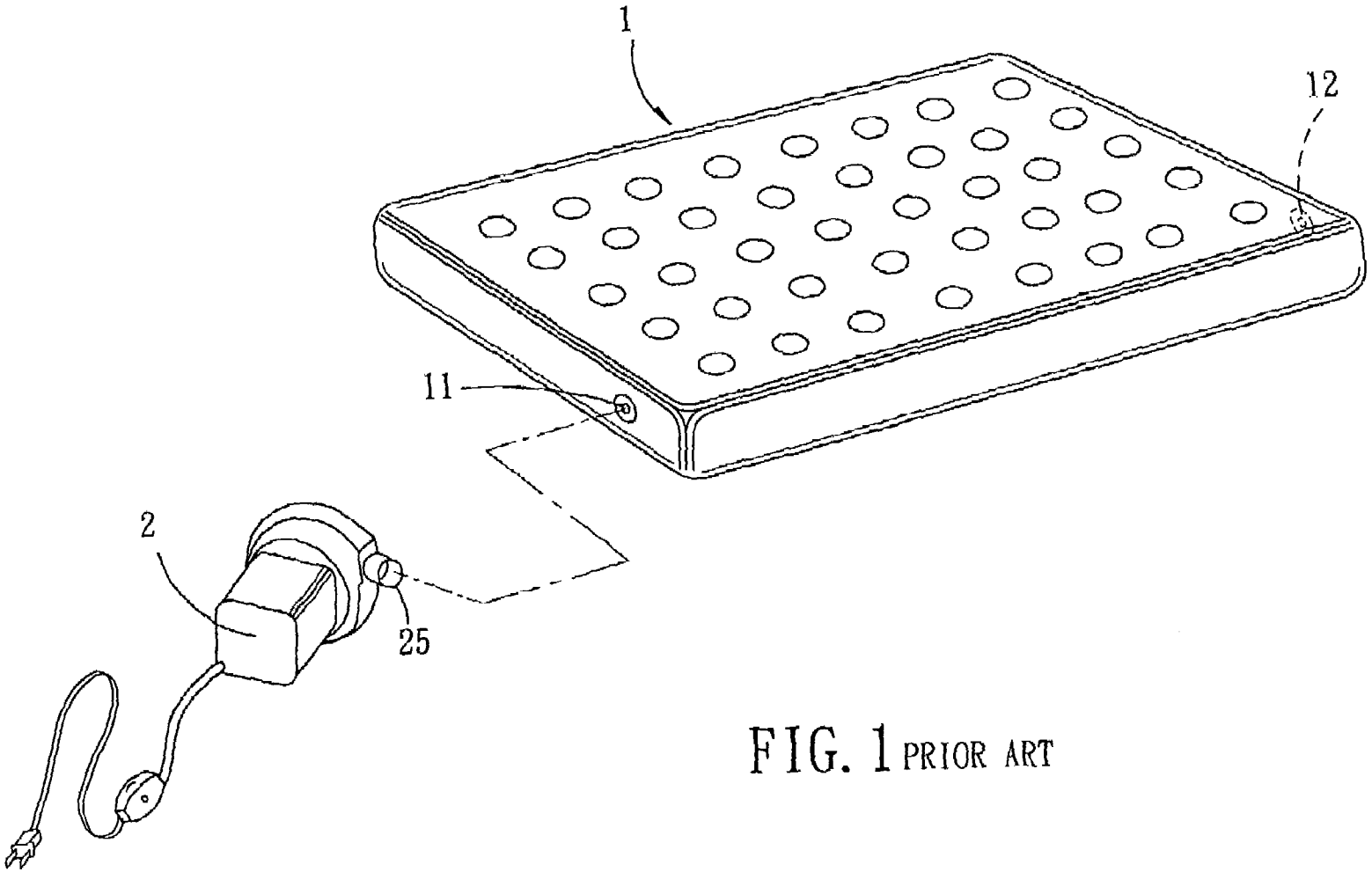
FIG. 1 PRIOR ART
FIG. 1 is a perspective view of an inflatable bed and a conventional air pump.
Figure 2:
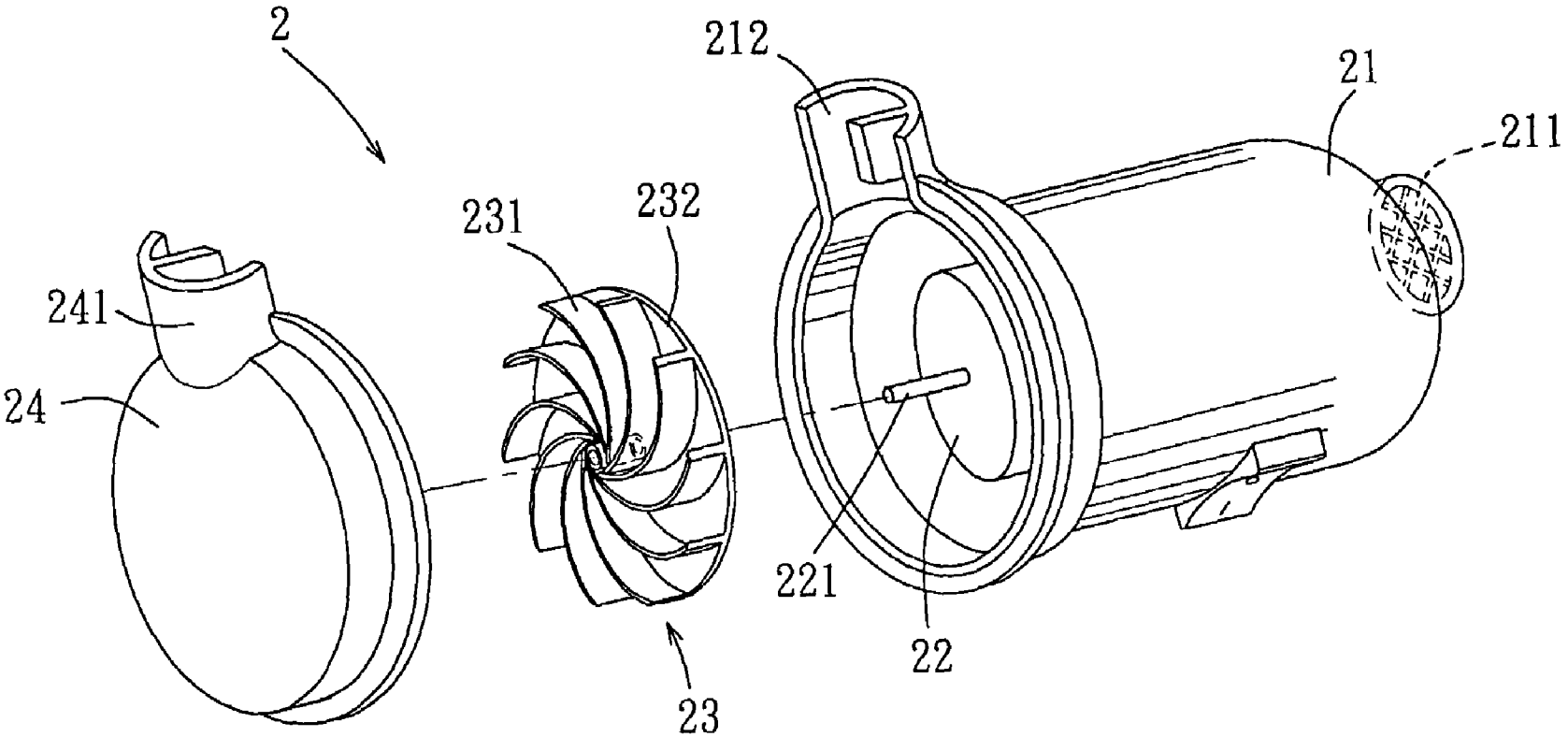
FIG. 2 PRIOR ART
FIG. 2 is a partly exploded perspective view of the conventional air pump.
Figure 3:
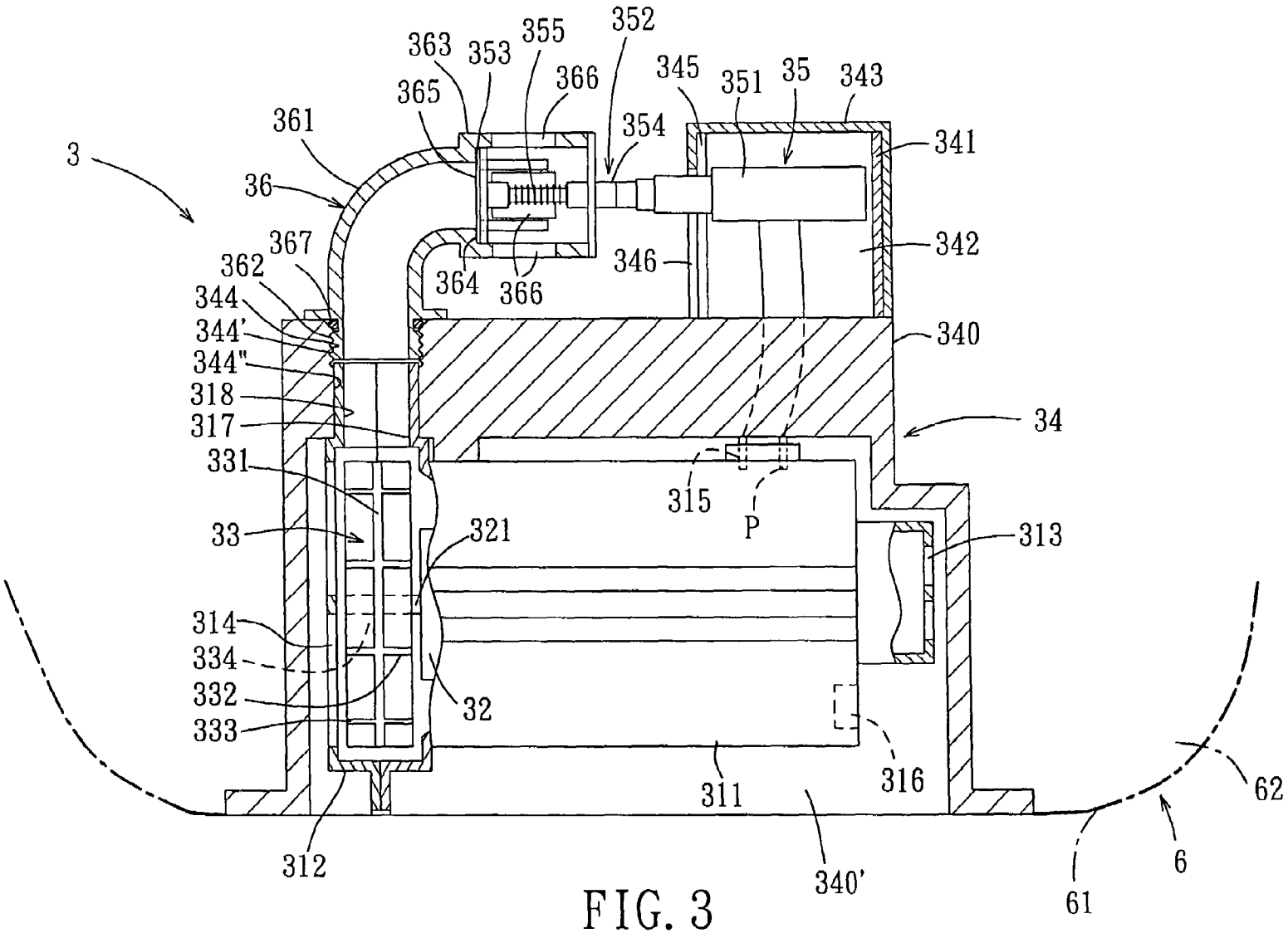
FIG. 3 is a partly sectional side view of the preferred embodiment of an air pump according to this invention.
Figure 4:
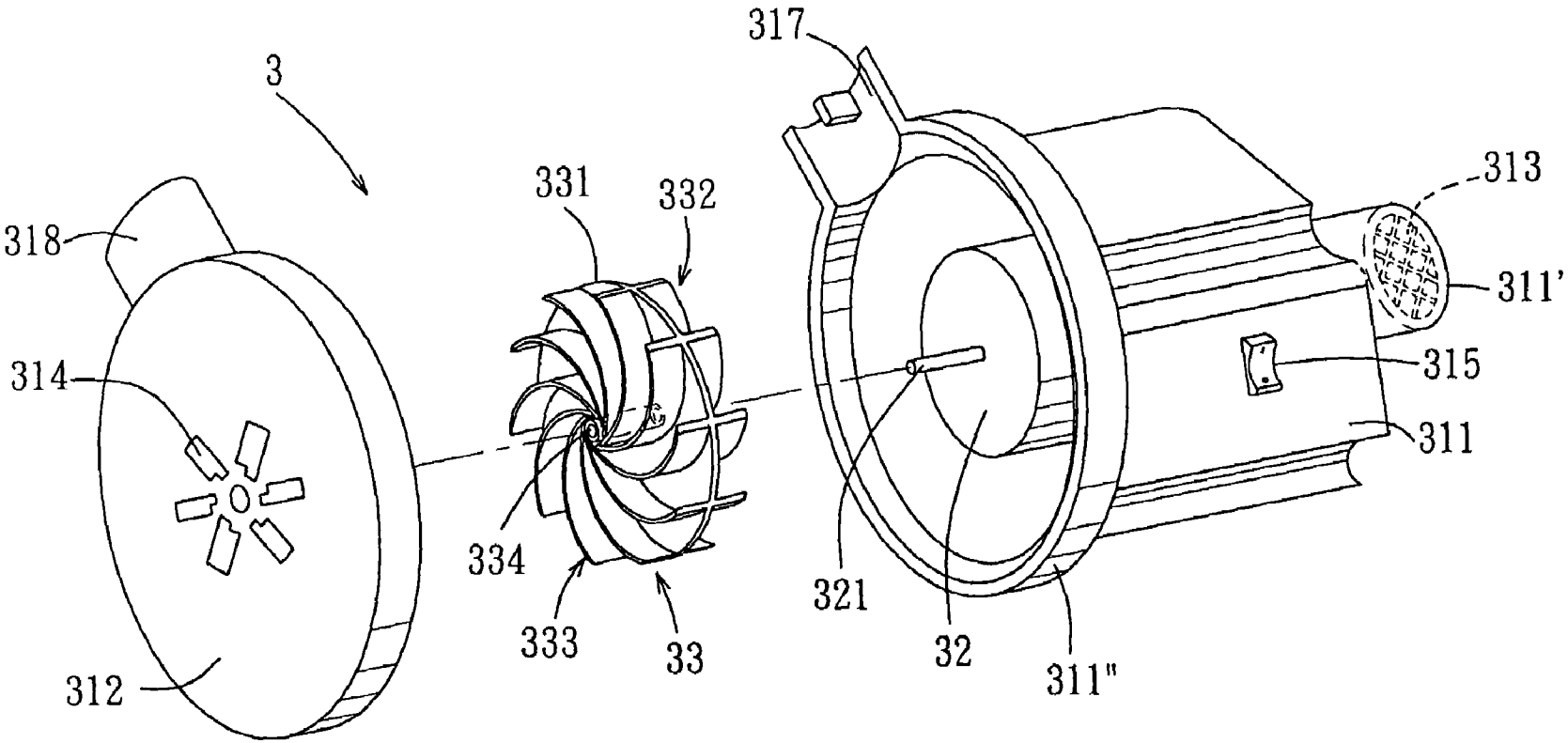
FIG. 4 is a partly exploded perspective view of a housing body, a cap, a motor and a fan of the preferred embodiment.
Figure 5:
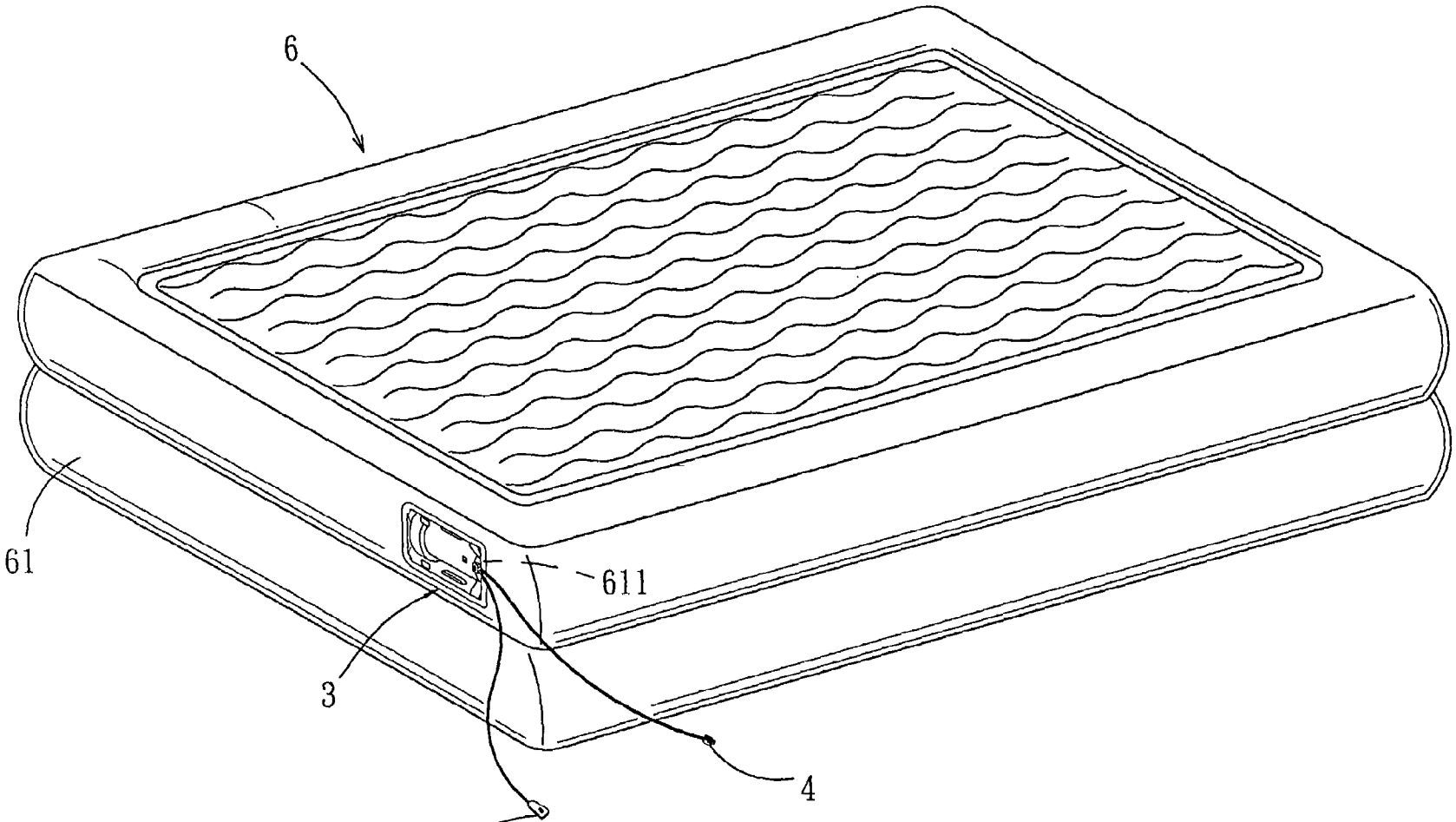
FIG. 5 is an assembled perspective view of an inflatable bed and the preferred embodiment, illustrating how the preferred embodiment is mounted to the inflatable bed.

Referring to FIGS. 3, 4 and 5, the preferred embodiment of an air pump 3 is capable of inflating an inflatable bed 6, and is shown to include a housing unit, a motor 32, a fan 33, a base 34, a solenoid valve assembly 35 and a controller 37 for controlling the activation of the solenoid valve assembly 35 and the starting of the motor 32. The inflatable bed 6 has a bed body 61 that defines an interior chamber 62 and that is formed with an air inlet 611.

The housing unit includes a tubular housing body 311, a cap 312 and an air conduit 36. The housing body 311 receives the motor 32 therein, and has a first end 311' that is formed with a first intake port unit 313, and a second end 311" that is opposite to the first end 311' and that is formed with a first projection 317. The first projection 317 extends radially and outwardly from the second end 311" of the housing body 311. The housing body 311 further includes first and second sockets 315, 316. The second socket 316 is in electrical connection with a power plug of a power line 4. The cap 312 is connected fixedly to the second end 311" of the housing body 311, and has a second intake port 314, and a second projection 318 extending radially and outwardly therefrom. The second projection 318 cooperates with the first projection 317 to form an exhaust tube. The air conduit 36 includes a conduit body 361, an inner end portion 362 and an enlarged outer end portion 363. An inner wall surface of the air conduit 36 is formed with a shoulder 364 at the junction between the conduit body 361 and the enlarged outer end portion 363. An exhaust port unit 365 is formed in the air conduit 36, and is disposed between the conduit body 361 and the enlarged outer end portion 363. The shoulder 364 is disposed around the exhaust port unit 365. The outer end portion 363 is formed with a plurality of vent holes 366 that are in fluid communication with the interior space 62 in the inflatable bed 6.

The motor 32 is disposed within the housing body 311, and includes a driving shaft 321 journalled in the housing body 311.

The fan 33 is disposed between the housing body 311 and the cap 312, and is aligned with the first and second projections 317, 318 in a radial direction of the driving shaft 321 of the motor 32. The fan 33 includes a middle plate 331, a pair of first and second fan blade units 332, 333 and a mounting tube 334. The mounting tube 334 is sleeved fixedly on the driving shaft 321 of the motor 32. The middle plate 331 is connected fixedly to the mounting tube 334. The first fan blade unit 332 extends from one side surface of the middle plate 331 toward the first intake port unit 313. The second fan blade unit 333 extends from the other side surface of the middle plate 331 toward the second intake port unit 314.

As such, when the motor 32 is driven to rotate the fan 33 within the housing body 311, air is sucked into a space between the housing body 311 and the cap 312 by the first and second fan blade units 332, 333 through the first and second intake ports 313, 314, respectively. Thereafter, the air is forced out of the space between the housing body 311 and the cap 312 by the first and second fan blade units 332, 333 through the exhaust tube defined by the first and second projections 317, 318.

The base 34 includes a base body 340, a surrounding wall unit 341, an accommodating chamber 342 defined by the surrounding wall unit 341, and a cover 343 sleeved around the surrounding wall 341. A through hole 344 is formed through the base body 340, and includes an upper threaded hole portion 344' and a lower non-threaded hole portion 344". The inner end portion 362 of the air conduit 36 is externally threaded, and engages threadably the threaded hole portion 344' of the through hole 344 in the base 34. An O-ring 367 is disposed between the inner end portion 362 of the air conduit 36 and the base body 340 of the base 34 so as to establish an airtight seal therebetween. The exhaust tube defined by the first and second projections 317, 318 is fitted within the non-threaded hole portion 344" of the through hole 344 in the base 34, and is in fluid communication with the inner end portion 362 of the air conduit 36. An opening 345 is formed through the surrounding wall unit 341, and is communicated with the accommodating chamber 342. A notch 346 is formed in the cover 343, and is aligned with the opening 345 in the surrounding wall unit 341.

The solenoid valve assembly 35 includes a solenoid unit 351, a driving unit 352 and a valve plate 353. The solenoid unit 351 is disposed within the accommodating chamber 342 in the base 34, and is provided with a plug (P) that is in electrical connection with the first socket 315 of the housing body 311 for supplying electricity necessary for the operation of the solenoid valve assembly 35. The driving unit 352 interconnects the solenoid unit 351 and the valve plate 353, and is driven by the solenoid unit 351 to move the valve plate 353 within the outer end portion 363 of the air conduit 36 between a sealing position shown in FIG. 3 and a non-sealing position shown in FIG. 6. When the valve plate 353 is disposed at the sealing position, it abuts against the shoulder 364 of the air conduit 36 so as to prevent flow of air from the housing unit. When the valve plate 353 is disposed at the non-sealing position, it is removed from the shoulder 364 so as to allow for the flow of the air from the housing unit. The driving unit 352 includes a valve rod 354 connected fixedly to the valve plate 353, and a coiled compression spring 355 biasing the valve plate 353 to press against the shoulder 364 of the air conduit 36.

The controller 37 is configured as a mode selection switch that is operable to select an inflating mode for inflating the inflatable bed 6, a deflating mode for deflating the inflatable bed 6, and a stopping mode for stopping the operation of the motor 32.

Figure 6:
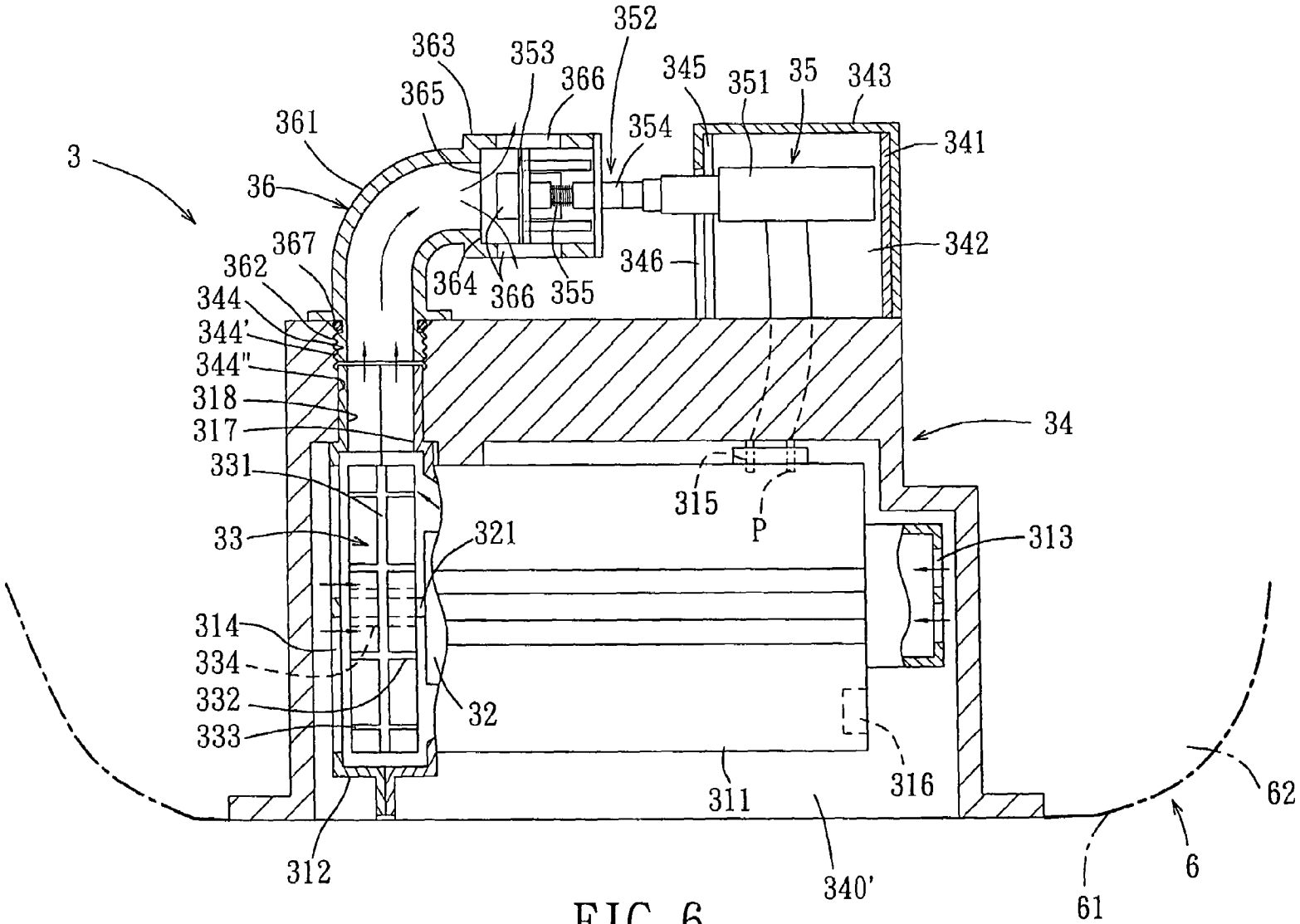
FIG. 6 is a partly sectional side view of the preferred embodiment, illustrating how an inflatable bed is inflated by the preferred embodiment.

When the inflating mode is selected, the solenoid unit 351 is activated by the controller 37 to remove the valve plate 353 from the shoulder 364, as shown in FIG. 6, and the motor 32 is started by the controller 37 to rotate the fan 33 relative to the housing body 311. As such, the exhaust port unit 365 is in fluid communication with the vent holes 366, and air is forced into the air conduit 36 by the fan 33. As a result, the inflatable bed 6 is inflated. Subsequently, the controller 37 is switched to the stopping mode so as to stop the operations of the solenoid unit 351 and the motor 32. Hence, the spring 355 biases the valve plate 353 to press against the shoulder 364, as shown in FIG. 3. The exhaust port unit 365 is therefore closed to stop airflow between the inflatable bed 6 and the air pump 3 through the air inlet 611 in the inflatable bed 6.

When the deflating mode is selected, the motor 32 is maintained at an inoperative state, and the valve plate 353 is moved to the non-sealing position under control of the controller 37 so as to allow for flow of air from the inflatable bed 6 into the air pump 3. Hence, air can flow out of the air pump 3 through the first and second intake port units 313, 314.

Since the fan 33 has two fan blade units (i.e. the first and second fan blade units 332, 333), the inflating performance of the air pump 3 is enhanced.

With this invention thus explained, it is apparent that numerous modifications and variations can be made without departing from the scope and spirit of this invention. It is therefore intended that this invention be limited only as indicated by the appended claims.

I claim:

1. An air pump adapted to inflate an inflatable object, the inflatable object having an air inlet, said air pump comprising:

a housing unit having a pair of first and second intake port units, and an exhaust port unit that is adapted to be in fluid communication with the air inlet in the inflatable object;

a motor installed within said housing unit and including a driving shaft journalled in said housing unit;

a fan disposed within said housing unit and including a middle plate connected fixedly to said driving shaft of said motor, and a pair of first and second fan blade units extending respectively from two opposite side surfaces of said middle plate, said motor being driven to rotate said fan within said housing unit, air being sucked into said housing unit by said first and second fan blade units through said first and second intake port units, respectively, and being subsequently forced out of said housing unit by said first and second fan blade units through said exhaust port unit;

a base; and a solenoid valve assembly, said solenoid valve assembly including a solenoid unit, a driving unit and a valve plate;

wherein said housing unit and said solenoid unit being disposed within said base, said driving unit interconnecting said solenoid unit and said valve plate and being driven by said solenoid unit to move said valve plate between a sealing position, where flow of air from said housing unit through said exhaust port unit is prevented, and a non-sealing position, where the flow of the air from said housing unit through said exhaust port unit is allowed.

2. The air pump as claimed in claim 1, wherein said fan further includes a mounting tube that is sleeved fixedly on said driving shaft of said motor and that is connected fixedly to said middle plate.

3. The air pump as claimed in claim 1, wherein said housing unit includes a first socket, said base including a recess for receiving said housing unit, said solenoid unit being provided with a plug that is in electrical connection with said first socket of said housing unit for supplying electricity necessary for operation of said solenoid valve assembly.

4. The air pump as claimed in claim 3, wherein said housing unit further includes a second socket adapted to be in electrical connection with a power plug of a power line.

5. The air pump as claimed in claim 1, further comprising a controller for controlling activation of said solenoid valve assembly and starting of said motor.

6. The air pump as claimed in claim 5, wherein said controller is configured as a mode selection switch that is operable to select an inflating mode for inflating the inflatable object, a deflating mode for deflating the inflatable object, and a stopping mode for stopping operation of said motor.

7. The air pump as claimed in claim 1, wherein said housing unit includes:

a tubular housing body receiving said motor therein and having a first end that is formed with said first intake port unit, and a second end that is opposite to said first end and that is formed with a first projection, said first projection extending radially and outwardly from said second end of said housing body; and a cap connected fixedly to said second end of said housing body and having a second projection extending radially and outwardly therefrom, said second projection cooperating with said first projection to form an exhaust tube that is in fluid communication with said exhaust port unit, said fan being disposed between said housing body and said cap and being aligned with said exhaust tube in a radial direction of said driving shaft of said motor.

8. The air pump as claimed in claim 7, wherein said housing unit further includes an air conduit that has a conduit body, an inner end portion in fluid communication with an end of said exhaust tube, and an enlarged outer end portion defining a shoulder at an inner wall surface of said air conduit at a junction between said conduit body and said outer end portion, said exhaust port unit being disposed between said conduit body and said enlarged outer end portion such that said shoulder is disposed around said exhaust port unit, said valve plate being movable within said enlarged outer end portion of said air conduit, said valve plate abutting against said shoulder of said air conduit when disposed at said sealing position, said valve plate being removed from said shoulder when disposed at said non-sealing position.

9. The air pump as claimed in claim 8, wherein said enlarged outer end portion of said air conduit is formed with at least one vent hole which is in fluid communication with said exhaust port unit and which is adapted to be in fluid communication with an interior space in the inflatable object.

10. The air pump as claimed in claim 9, wherein said inner end portion of said air conduit is externally threaded, said base having a through hole formed therethrough, said through hole having a threaded hole portion that engages threadably the inner end portion of said air conduit, and a non-threaded hole portion, said exhaust tube being fitted within said non-threaded hole portion of said through hole in said base and being in fluid communication with said inner end portion of said air conduit.

11. The air pump as claimed in claim 10, further comprising an O-ring disposed between said inner end portion of said air conduit and said base so as to establish an airtight seal therebetween.

* * * * *